US005485193A

United States Patent [19]

Inoue et al.

[11] Patent Number: 5,485,193

[45] Date of Patent: Jan. 16, 1996

[54] THERMAL HEAD INCLUDING AT LEAST ONE PARALELLOGRAMMATIC RESISTOR

[75] Inventors: Nobuhiro Inoue, Hachioji; Katsunari Sasaki, Hino; Toshiro Nose, Sagamihara; Yoshio Hatate, Musashino, all of Japan

[73] Assignee: Kabushiki Kaisha Toshiba, Kawasaki, Japan

[21] Appl. No.: 122,175

[22] Filed: Sep. 17, 1993

Related U.S. Application Data

[63] Continuation of Ser. No. 7,029, Jan. 21, 1993, abandoned, which is a continuation of Ser. No. 888,296, May 26, 1992, abandoned, which is a continuation of Ser. No. 558,480, Jul. 27, 1990, abandoned.

[30] Foreign Application Priority Data

Jul. 28, 1989 [JP] Japan ..... 1-195686
Mar. 19, 1990 [JP] Japan ..... 2-66954

[51] Int. Cl.[6] ..... B41J 2/345

[52] U.S. Cl. ..... 347/206; 347/188

[58] Field of Search ..... 346/76 PH, 400; 400/120; 338/333; 347/206, 209, 188

[56] References Cited

U.S. PATENT DOCUMENTS

| | | | |
|---|---|---|---|
| 4,514,736 | 4/1985 | Moriguchi et al. | 346/76 PH |
| 4,698,643 | 10/1987 | Nishiguchi et al. | 346/76 PH |
| 4,737,860 | 4/1988 | Ono et al. | 346/76 PH |
| 4,851,861 | 7/1989 | Kikuchi et al. | 346/76 PH |

FOREIGN PATENT DOCUMENTS

| | | | |
|---|---|---|---|
| 10037664 | 10/1981 | European Pat. Off. . | |
| 10310378 | 4/1989 | European Pat. Off. . | |
| 0085435 | 7/1978 | Japan | 346/76 PH |
| 163679 | 9/1983 | Japan . | |
| 208076 | 12/1983 | Japan | 346/76 PH |
| 0178268 | 10/1984 | Japan | 346/76 PH |
| 60-78768 | 4/1985 | Japan . | |
| 60-58877 | 5/1985 | Japan . | |
| 0108071 | 5/1987 | Japan | 219/216 PH |

OTHER PUBLICATIONS

Tsumura et al., Half–Tone Wax Transfer Using a Novel Thermal Head, published in The Fourth International Congress on Advances in Non–impact Printing Technologies, Mar. 20–25, 1988, pp. 273–276.

*Primary Examiner*—N. Le
*Attorney, Agent, or Firm*—Finnegan, Henderson, Farabow, Garrett & Dunner

[57] ABSTRACT

A thermal head comprises a plurality of parallelogrammatic resistors for generating heat formed on an insulated substrate made of, such as ceramics or alumina. The resistors are aligned at regular intervals, and one pair of opposite sides of each resistor are connected individually to lead electrodes. These opposite sides are equal to or longer than the other opposite sides, and an acute angle formed between each two intersecting sides is 45° or less. The resistor is heated by various electric currents to record printing dots of various sizes.

10 Claims, 18 Drawing Sheets

THERMAL HEAD INCLUDING AT LEAST ONE PARALELLOGRAMMATIC RESISTOR

This application is a continuation of application Ser. No. 08/007,029 filed Jan. 21, 1993, now abandoned, which is a continuation of Ser. No. 07/888,296, filed May 26, 1992, now abandoned, which is a continuation of application Ser. No. 07/558,480, filed Jul. 27, 1990, now abandoned.

BACKGROUND OF THE INVENTION

1. Field of the Invention

The present invention relates to a thermal head, and more particularly, to a thermal head capable of half-tone printing.

2. Description of the Related Art

Thermal heads with a novel faculty have been intensively developed of late such that half-tone printing can be effected by changing the size of printing dots to be printed. Such thermal heads are disclosed in "Half Tone Wax Transfer Using a Novel Thermal Head", THE FOURTH INTERNATIONAL CONGRESS ON ADVANCES IN NON-IMPACT PRINTING TECHNOLOGIES pp. 273–276, "Thermo-Convergent Ink-Transfer Printing (TCIP) for Full Color Reproduction", Proceedings of 2nd Non-impact Printing Technologies Symposium pp. 105–108, "Published Unexamined Japanese Patent Application Nos. 60-58877 and 60-78768". Each of the thermal heads is provided with a number of heating resistors each having a narrow-width portion. Electric current flowing through each heating resistor increases its density at the narrow-width portion, so that heat is produced from a local region in the high-density portion. In thermal heads, only those regions which produce heat higher than a certain value are effective for printing, and the regions capable of generating sufficient heat for the printing spread in proportion to voltage applied to the heating resistors. If higher voltage is applied to the heating resistors, therefore, the size of the printing dots increases in proportion.

In the conventional thermal head of this type, however, the heating resistors have a complicated configuration, so that manufacturing them requires much time and labor, and it is difficult to provide uniform properties for the numerous heating resistors.

SUMMARY OF THE INVENTION

The object of the present invention is to provide a thermal head of a simple construction capable of satisfactory half-tone printing.

For this end, the present invention provides a line-type thermal head, which comprises a substrate and a plurality of heating elements arranged on the substrate along a main scanning axis of the head, insulated from each other. Each heating element includes at least one parallelogrammatic resistor for generating heat and means for supplying electric current to the resistor to make it generate heat.

The supply means of the thermal head includes head electrodes, each having a width equal to or larger than the length of the one pair of opposite sides of the resistor, connected electrically to the one pair of opposite sides.

More preferably, the length of the one pair of opposite sides is equal to or greater than that of the other pair of opposite sides, and the acute angle formed by two adjacent sides is 45° or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Preferred embodiments of a thermal head according to the present invention will now be described with reference to the accompanying drawings.

Figure 1:
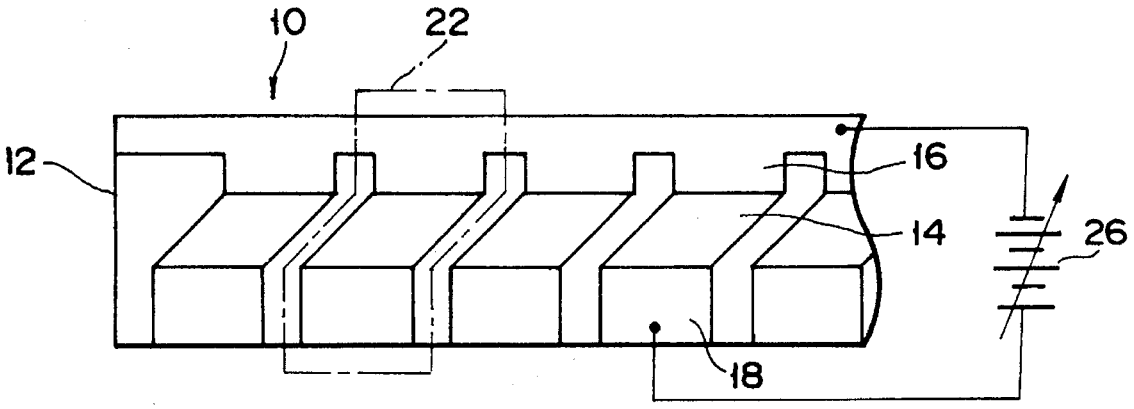
FIG. 1 is a schematic view for illustrating the configuration of a thermal head according to an embodiment of the present invention.

As shown in FIG. 1, a thermal head 10 comprises a plurality of parallelogrammatic heating resistors 14 formed on an insulated substrate 12 of ceramics or alumina. These heating resistors 14 are arranged at regular intervals in a straight line so that each pair of parallel opposite sides of each resistor 14 are connected individually to lead electrodes 16 and 18. These heating resistors 14 and lead electrodes 16 and 18 constitute one heating element 22 for recording one printing dot. The individual lead electrodes 16 are connected to one another, thus constituting a common electrode.

Figure 2:
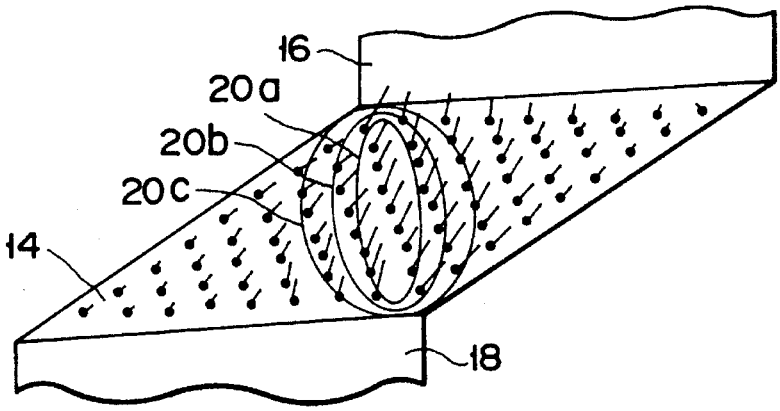
FIG. 2 is a schematic view for illustrating the current distribution and heating state in a heating resistor shown in FIG. 1.

When a voltage from a variable voltage source 26 is applied between the lead electrodes 16 and 18, for example, a current flows through the heating resistors 14, so that the resistors 14 are heated. FIG. 2 shows current distribution in the resistors 14. In FIG. 2, black spots represent points of measurement, the direction of each line indicates the direction of electric current at each corresponding measurement point, and the length of the line indicates the magnitude of the current at the measurement point.

The following is a description of the current distribution in the heating resistors 14 shown in FIG. 2. Here it is supposed that the resistance values of the resistors 14 cannot be changed by heating. For example, each resistor 14 is formed of a thin film whose thickness is so small that it is negligible. Thus, the current distribution is supposed to be two-dimensional.

Based on this supposition, the current flowing through the heating resistors 14 is a steady-state current, which generates a static magnetic field. Since magnetic flux density B makes no time-based change, therefore, the following equation is obtained from the Maxwell equation:

$$rot\,E = -\frac{\partial B}{\partial t} \quad (1)$$

where E is an electric field. Based on the principle of conservation of charge, moreover, we obtain $$\text{div } i=0, \quad (2)$$

where i is the current density. The Ohm's law is valid for the relation between the current density i and the electric field E as follows:

$$i=\sigma E, \quad (3)$$

where $\sigma$ is electric conductivity. Substituting equation (3) into equation (2), we obtain $$\text{div } E=0. \quad (4)$$

From equations (1) and (4), we recognizes a certain scalar function V, and the electric field E may be given by $$E=-\text{grad } V \quad (5)$$

This scalar function V is generally called as an electric potential. Substituting equation (5) into equation (4), in consideration of the two-dimensional current distribution, we obtain the following Laplace equation:

$$\frac{\partial^2 V}{\partial x^2}+\frac{\partial^2 V}{\partial y^2}=0 \quad (6)$$

Further, energy density $e_n$ is given by $$e_n=i\cdot E=\sigma E^2. \quad (7)$$

By obtaining the electric field E by substituting the solution of equation (6) into equation (5), therefore, heating energy distribution can be obtained from equation (7).

Figure 3:
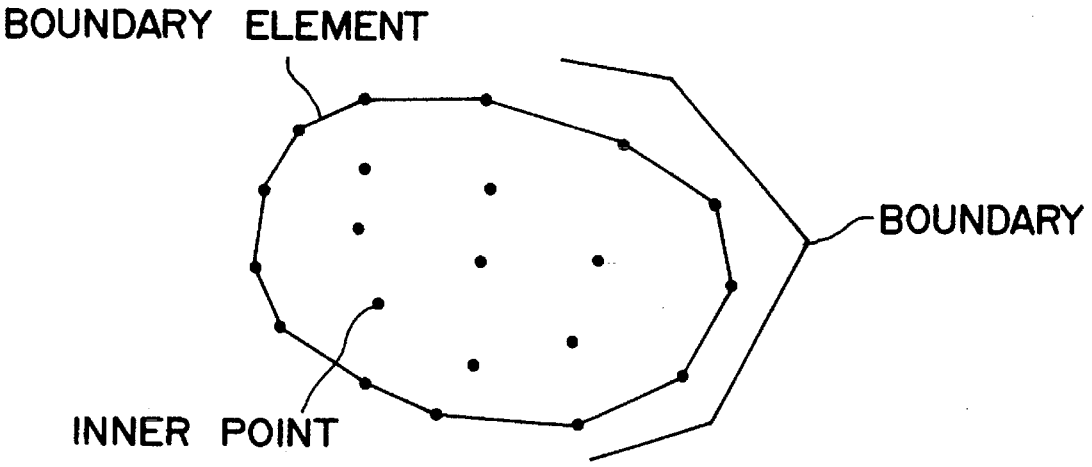
FIG. 3 is a diagram for illustrating the boundary element method.

Using the boundary element method, equation (6) will now be numerically analyzed. According to the boundary element method, as shown in FIG. 3, the boundary of a closed system is divided into elements, which are calculated using predetermined boundary conditions so that the solutions of all the elements are obtained. Thus, the internal conditions of the system are detected. As a result, the current distribution shown in FIG. 2 is obtained.

As seen from FIG. 2, there are larger current flows in the regions nearer to the center of each heating resistor 14. The heat release value at a certain point on the resistor 14 can be represented by the product of the square of the current value at that position and the resistance value of the resistor 14. Namely, the heat release value is proportional to the square of the current value. Thus, the heat value is large at the central portion of the heating resistor 14.

Meanwhile, recording of printing dots requires a fixed amount of heat or more. If the voltage applied to the heating resistor 14 is low, therefore, the printing dots are recorded by heating within a range indicated by numeral **20*a* in FIG. 2. As the applied voltage is increased, the printing dots start to be recorded by heating within ranges indicated by numerals 20*b* and 20*c***.

By changing the voltage applied to the heating resistor 14, the virtual heating area can be varied as indicated by **20*a*, 20*b* and 20*c* in FIG. 2**, for example, so that the size of the printing dots can be modulated.

Figure 4:
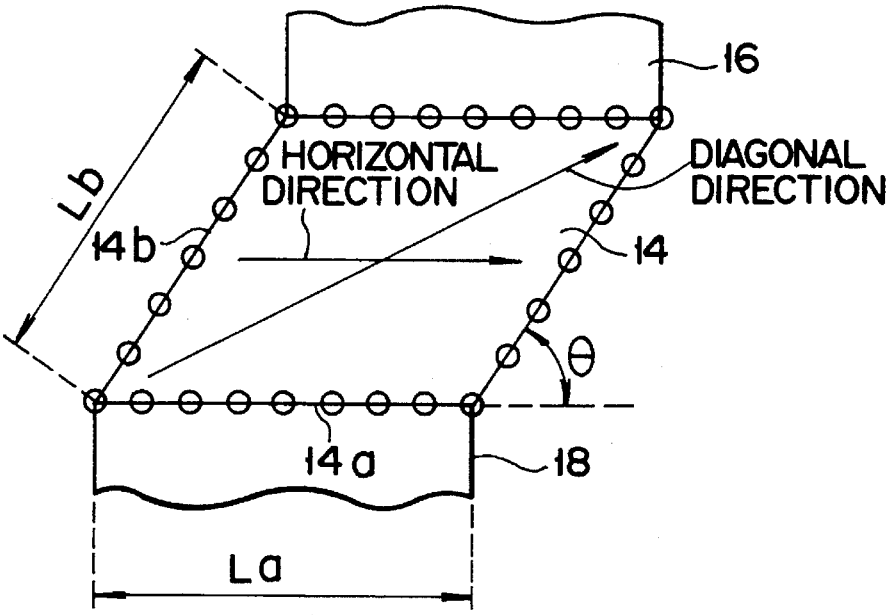
FIG. 4 is a diagram showing various pieces of information for specifying the shape of the heating resistor.

The current distribution in the heating resistor 14 varies depending on the shape of the resistor, and there is a resistor shape for optimum gradation recording. This is a shape which enables heat concentration to a certain degree or higher. Parameters indicative of a parallelogrammatic shape include the ratio g between the respective lengths La and Lb of sides **14*a* and 14*b* and the angle θ (acute angle in this case) formed between the sides 14*a* and 14*b*, as shown in FIG. 4**. The optimum shape can be obtained under the following conditions:

$$\text{ratio } g\ (=Lb/La) \leqq 1,$$

$$\text{angle } \theta \leqq 45°.$$

The following is a description of the optimum shape of the heating resistor 14. In the example described below, the thermal head is applied to a standard-G3 facsimile.

In the standard-G3 facsimile, the resolution in the main scanning direction (arrangement direction of the heating resistors 14) is specified as being 8 dots/mm, so that the width or length La of each heating resistor 14 is $$La \leqq 125\ \mu m.$$

If the gap between each two adjacent heating resistors 14 is 25 μm, La is $$La=100\ \mu m.$$

FIGS. 5A to 5L show various modes of current distribution obtained for 12 varied shapes by the aforementioned method using the outline of each heating resistor 14 as a boundary, as shown in FIG. 4, under conditions including La=100 μm and the respective electric potentials of the lead electrodes 16 and 18 at 24 V and 0 V. The 12 shapes may be classified into four types based on the combinations of the ratios g of 1, 1.5, and 2 and the angles θ of 30° (type (a)), 45° (type (b)), 60° (type (c)), and 75° (type (d)).

Figure 5A:
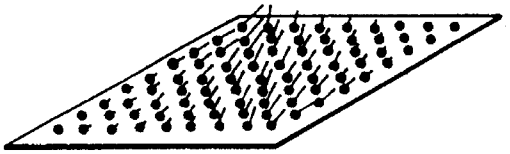
FIGS. 5A to 5L are schematic views showing the current distribution in heating resistors of various shapes obtained by the boundary element method.
Figure 5B:
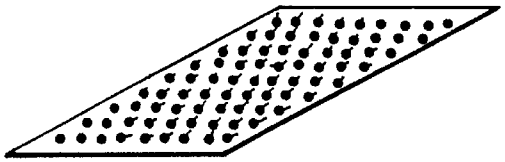
Figure 5C:
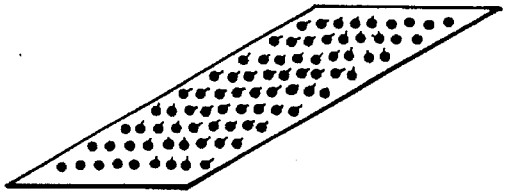
Figure 5D:
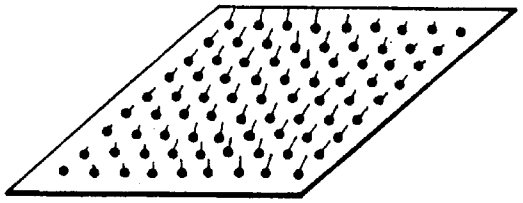
Figure 5E:
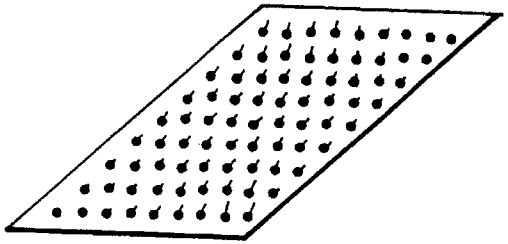
Figure 5F:
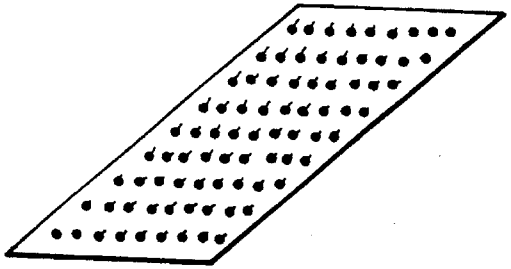
Figure 5G:
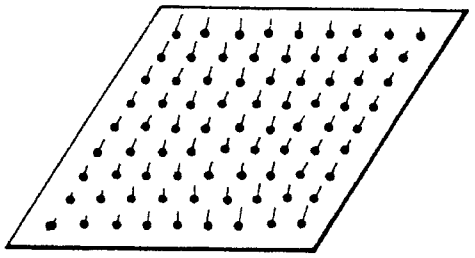
Figure 5H:
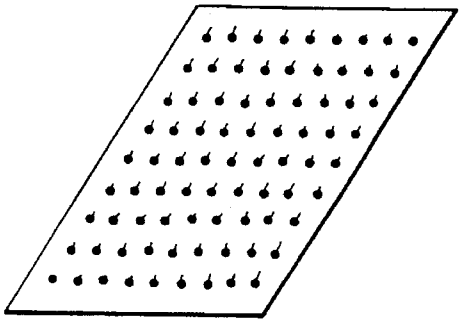
Figure 5I:
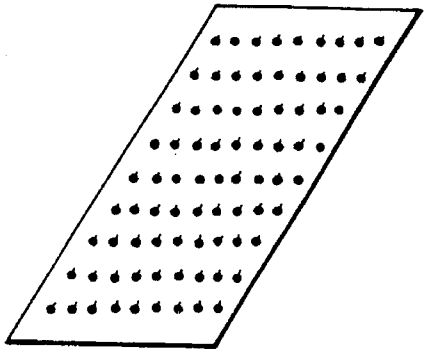
Figure 5J:
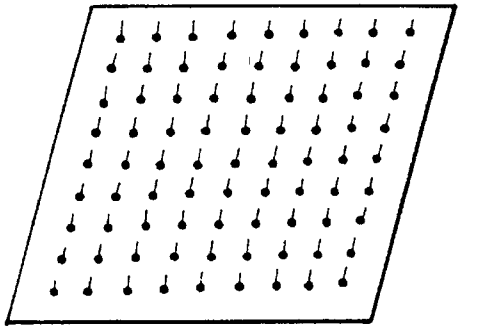
Figure 5K:
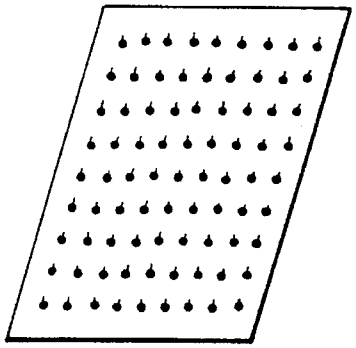
Figure 5L:
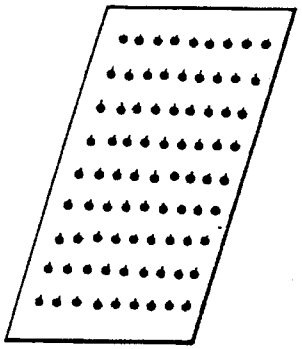

FIGS. 5A to 5C show cases corresponding to the ratios g of 1, 1.5, and 2, respectively, for type (a), and FIGS. 5D to 5F, 5G to 5I, and 5J to 5L show similar cases for types (b), (c), and (d), respectively.

The electric fields E in the horizontal and diagonal directions (see FIG. 4) are obtained for the individual heating resistors 14 having these shapes. FIGS. 6 to 11 show $e_n/\sigma$ obtained by dividing the energy density $e_n$, calculated according to equation (7) on the basis of the obtained electric fields E, by the electric conductivity $\sigma$.

Figure 6:
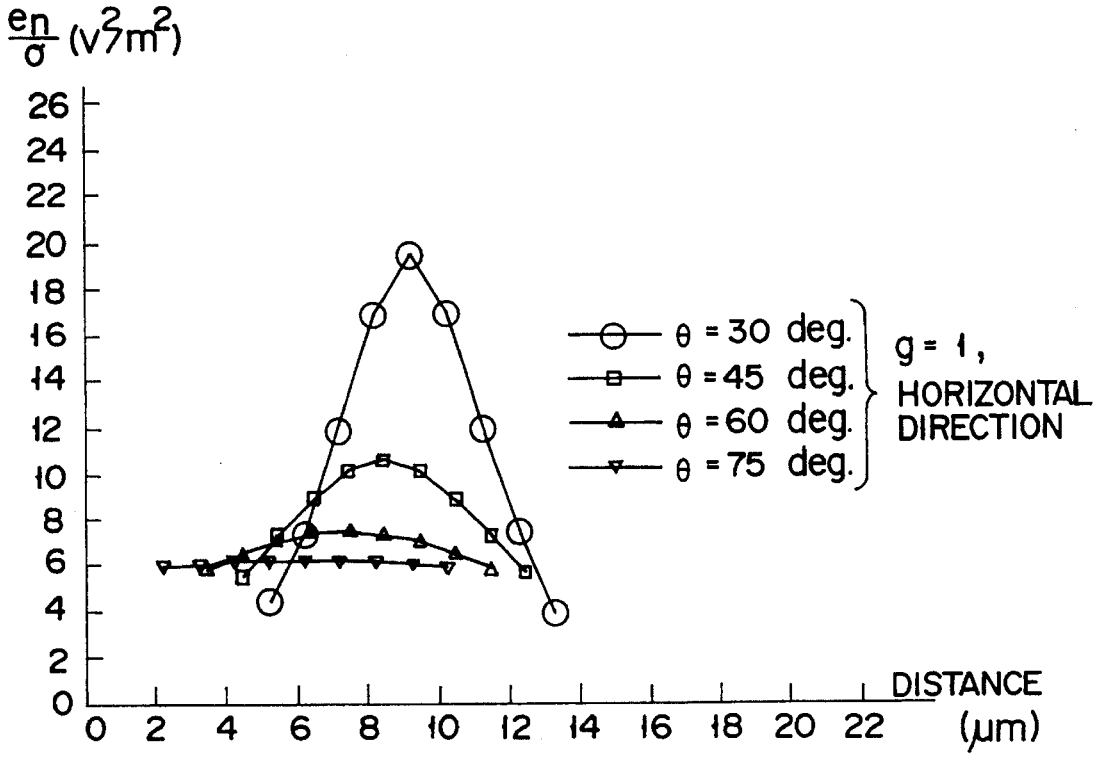
FIGS. 6 to 11 are diagrams showing energy distribution obtained by calculation.
Figure 7:
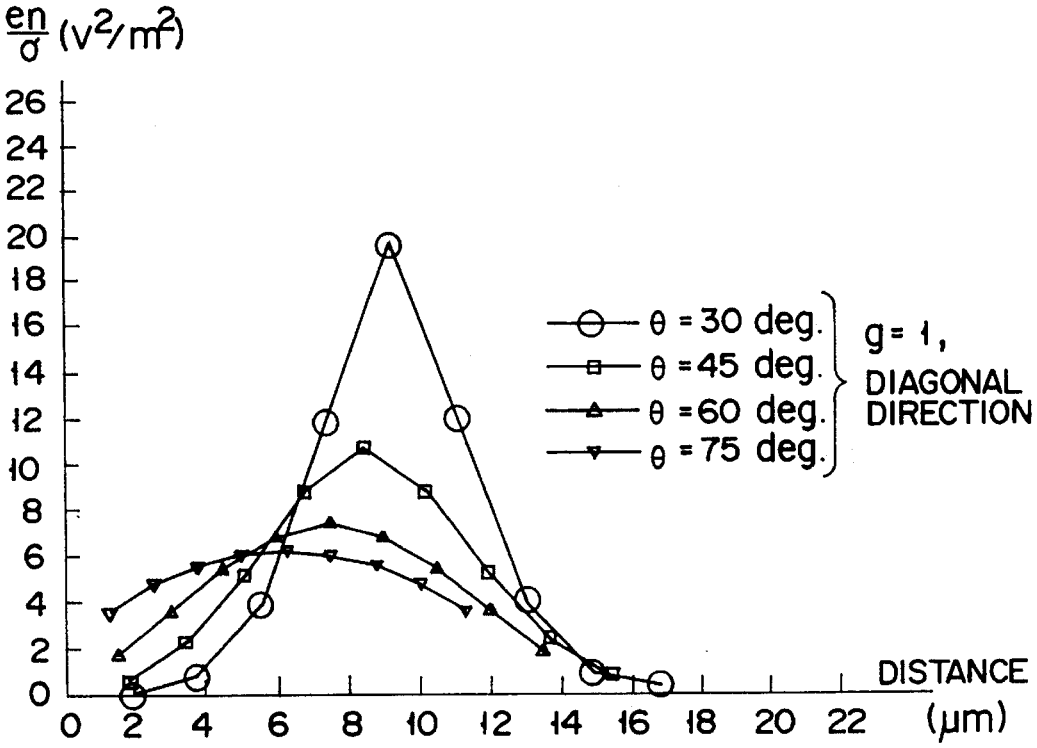
Figure 8:
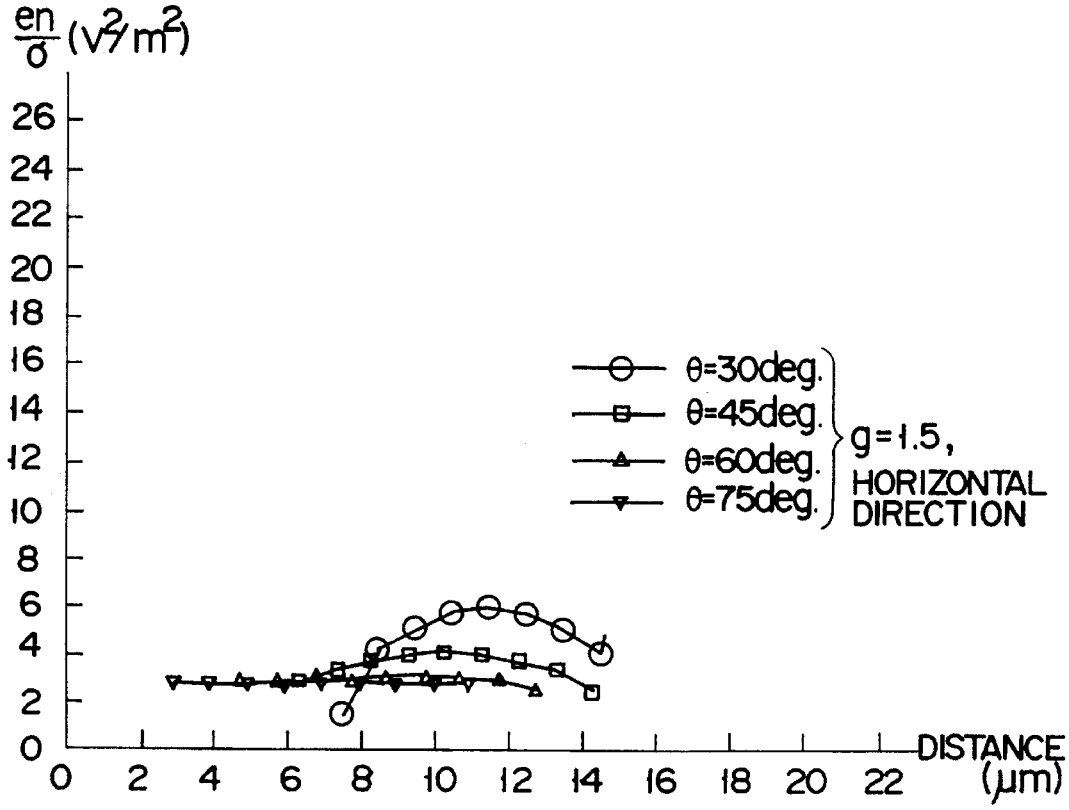
Figure 9:
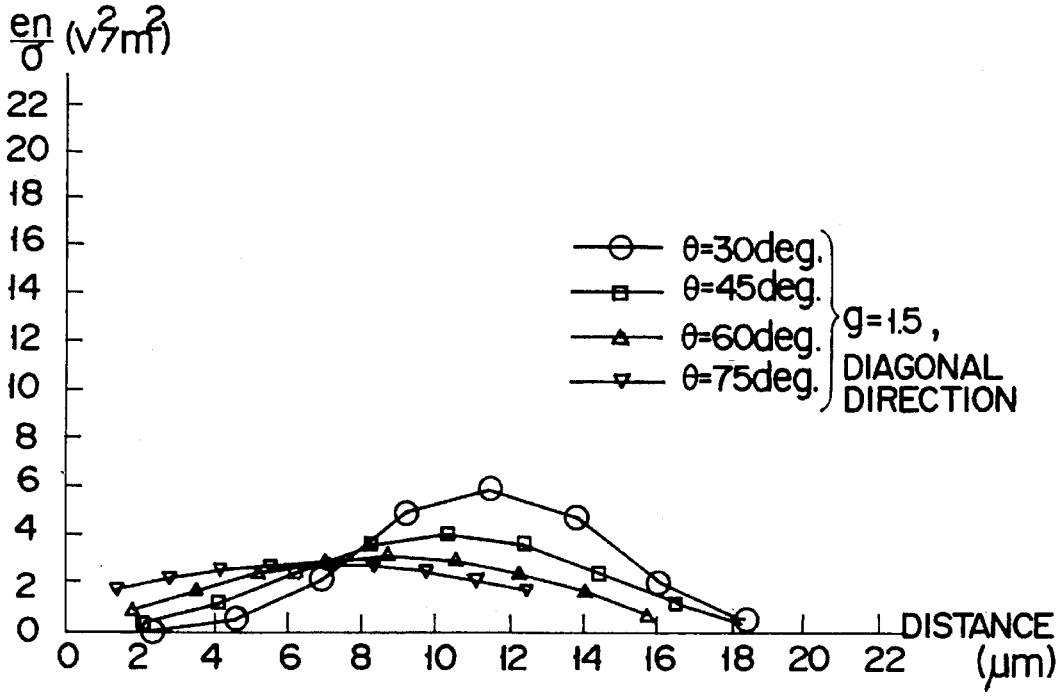
Figure 10:
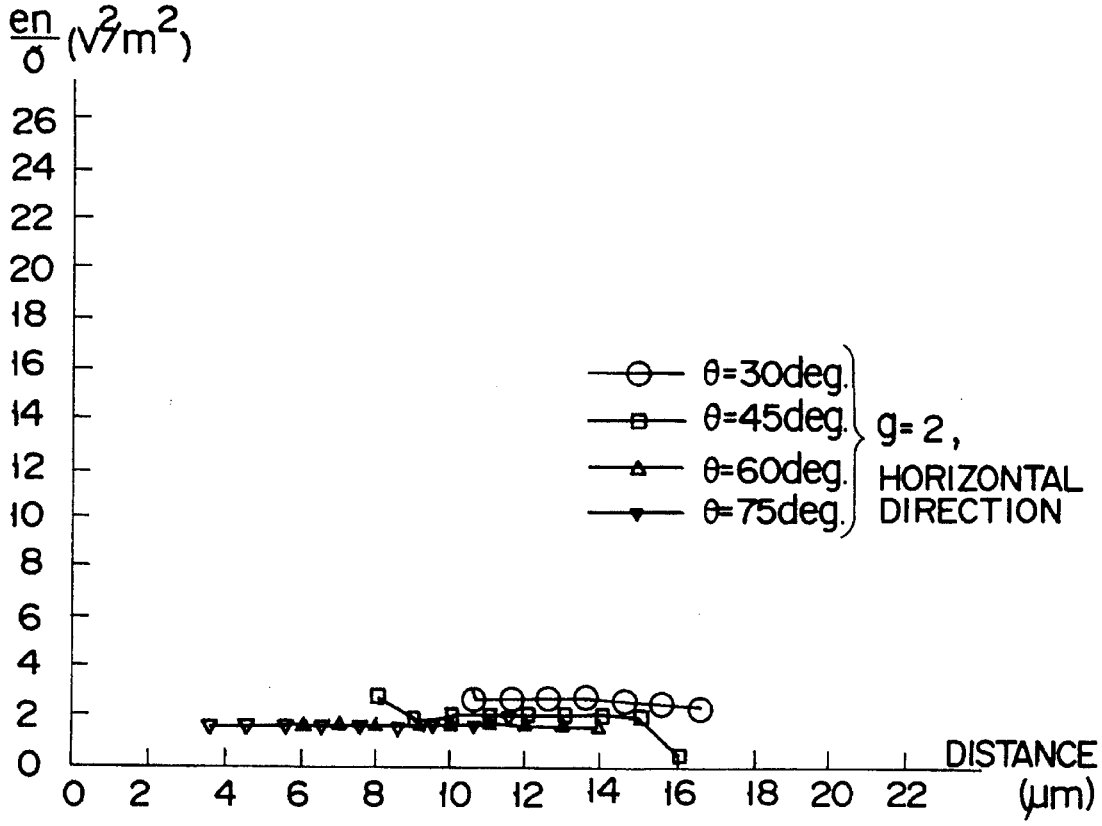
Figure 11:
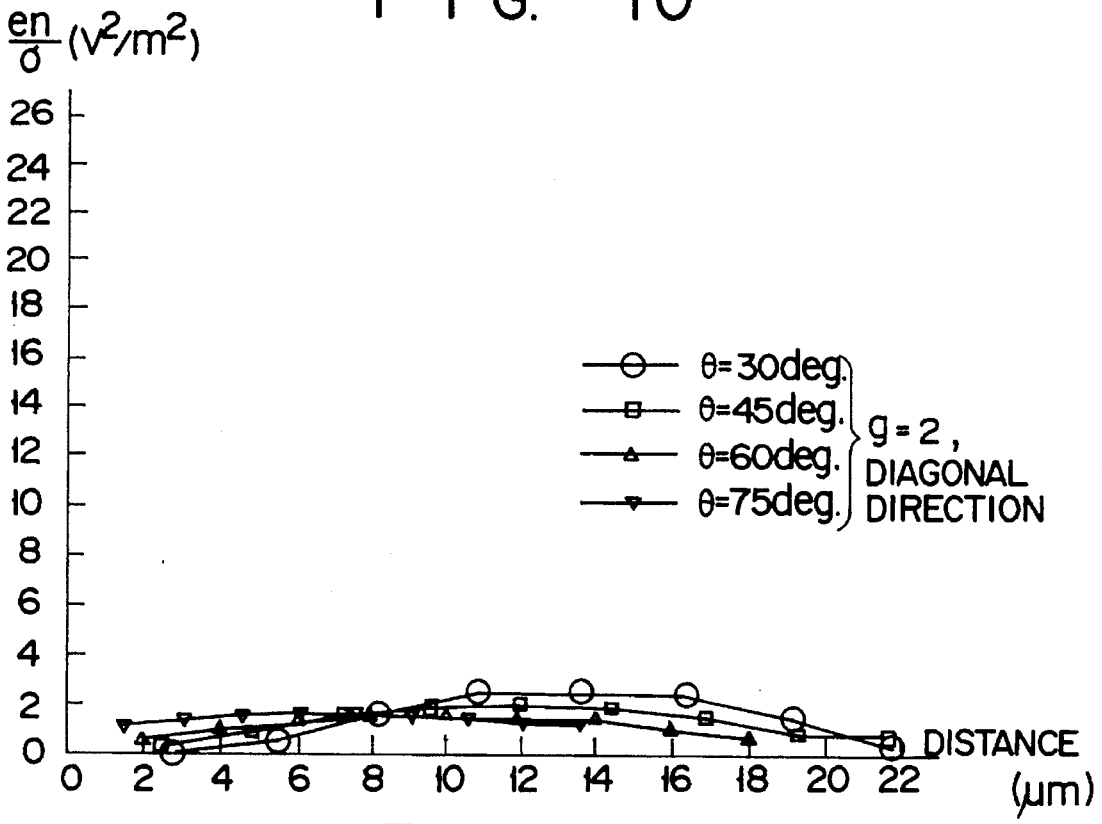

FIGS. 6 and 7 show cases corresponding to the horizontal and diagonal directions, respectively, for the ratio g of 1, FIGS. 8 and 9 show similar cases for the ratio g of 1.5, and FIGS. 10 and 11 show similar cases for the ratio g of 2.

As seen from FIGS. 5A to 5L and FIGS. 6 to 11, the smaller the angle θ and ratio g, the more intensive the centralization of the current is. FIGS. 6 to 11 indicate the following circumstances. If the ratio g is 2 (FIGS. 10 and 11), the energy distribution is substantially uniform, and there is hardly any energy concentration. If the ratio g is 1.5, some energy concentration is caused. If the ratio g is 1, a considerable energy concentration is entailed. As seen from FIGS. 6 and 7, moreover, if the ratio g is 1, the energy concentration is conspicuous when the angle θ is 45° or narrower.

It may be guessed from these results that the conditions for the optimum shape of each heating resistor 14 are $g \leqq 1$ and $\theta \leqq 45$.

The above is a theoretical description of the optimum shape of the heating resistor 14, while the following is a description based on experimental data.

In actually manufacturing the thermal head, the width (main scanning direction) and height (auxiliary scanning direction) of each heating resistor depend on the resolution to be obtained. For higher reproducibility, the resolution used for the standard-G3 facsimile, for example, is adjusted to 8 dots/mm in the main scanning direction and 15.4 lines/mm in the auxiliary scanning direction. Thus, the height h of each thermal head used in the standard-G3 facsimile is given by $$h \geqq 1/15.4. \quad (8)$$

Namely, the height h is expected to be about 65 μm or more. As mentioned before, moreover, the width or length La of the heating resistor 14 is 100 μm.

Figure 12A:
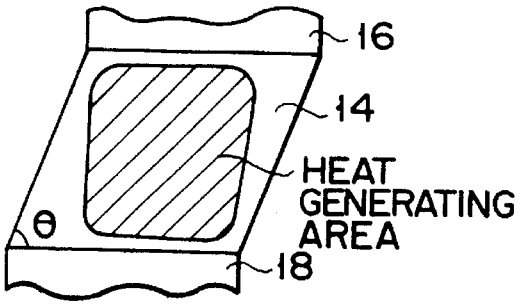
FIGS. 12A, 12B, 13A, 13B, 14A and 14B are diagrams for illustrating variations of the recording characteristics of uniform-height heating resistors with various angles.
Figure 12B:
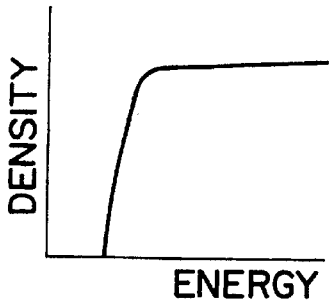
Figure 13A:
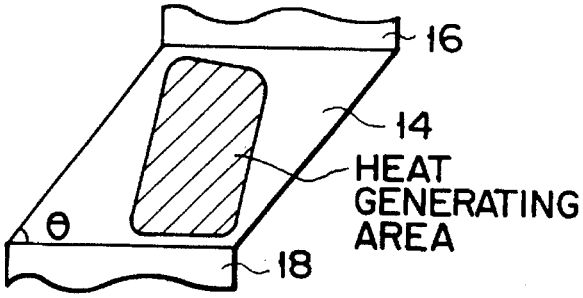
Figure 13B:
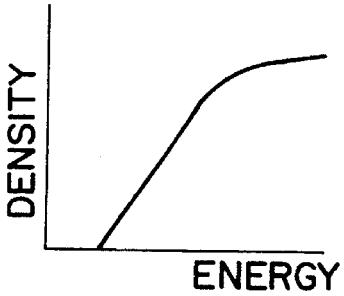
Figure 14A:
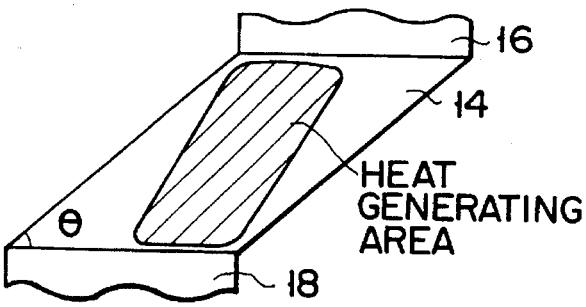
Figure 14B:
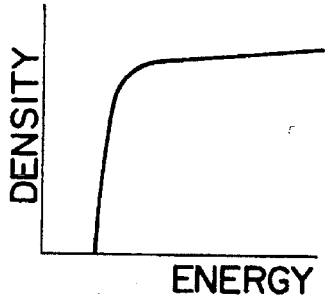
Figure 15:
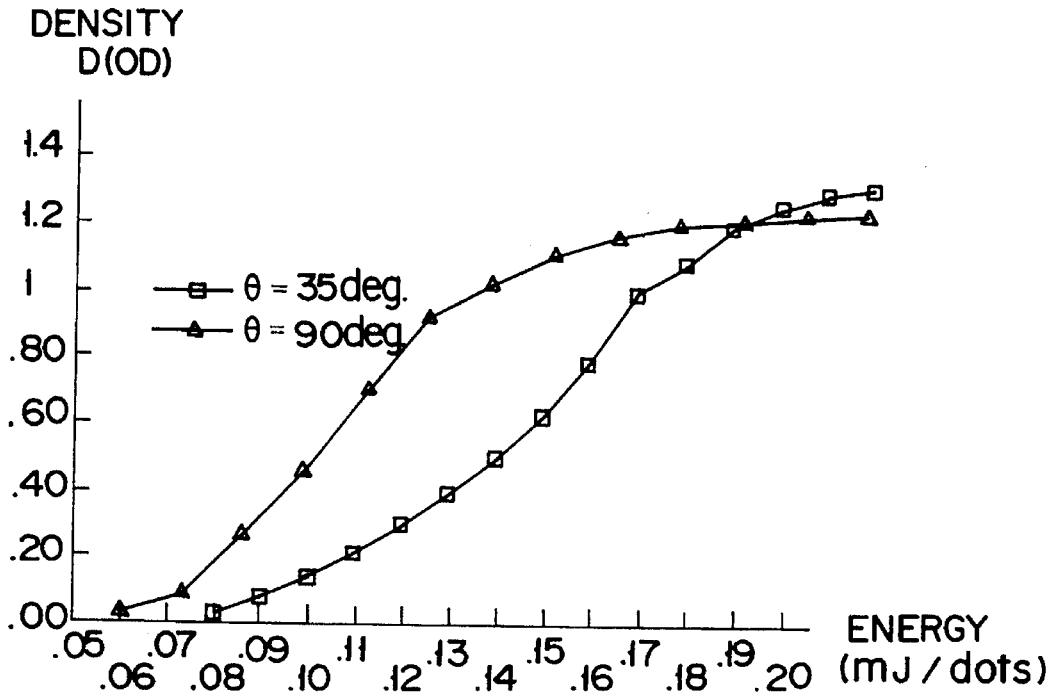
FIGS. 15 to 26 are graphs showing the results of measurement of the recording characteristics of the heating resistors with various angles.
Figure 16:
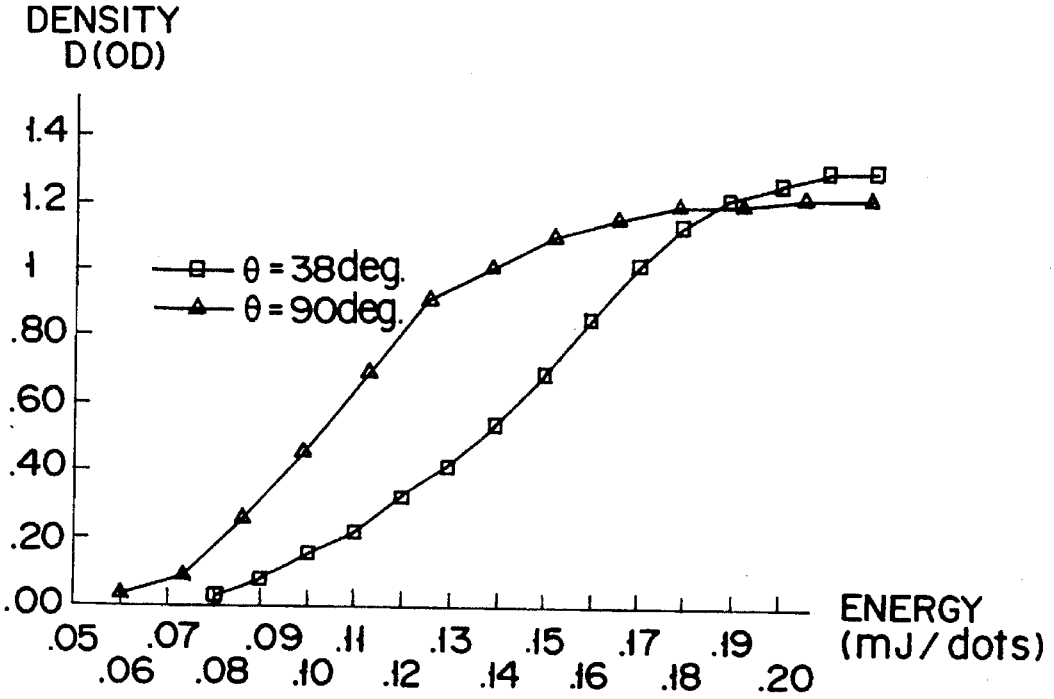
Figure 17:
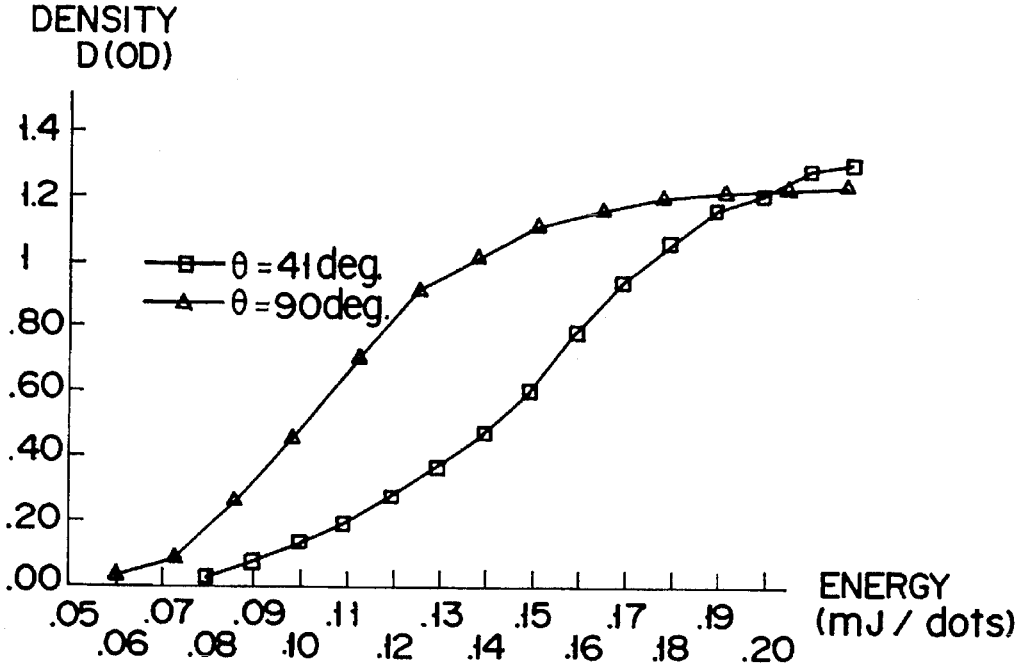
Figure 18:
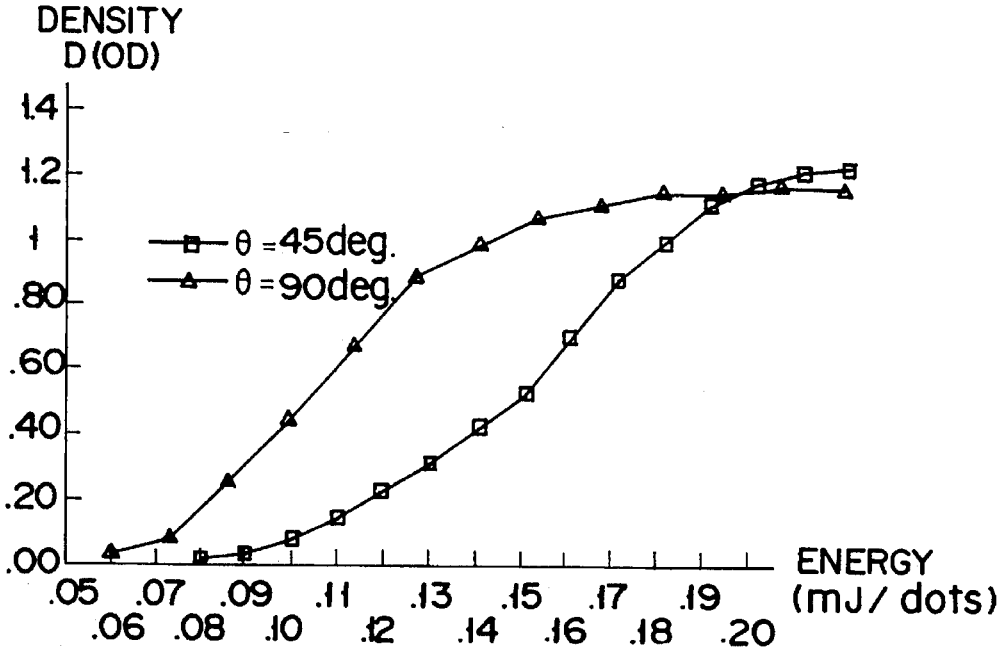
Figure 19:
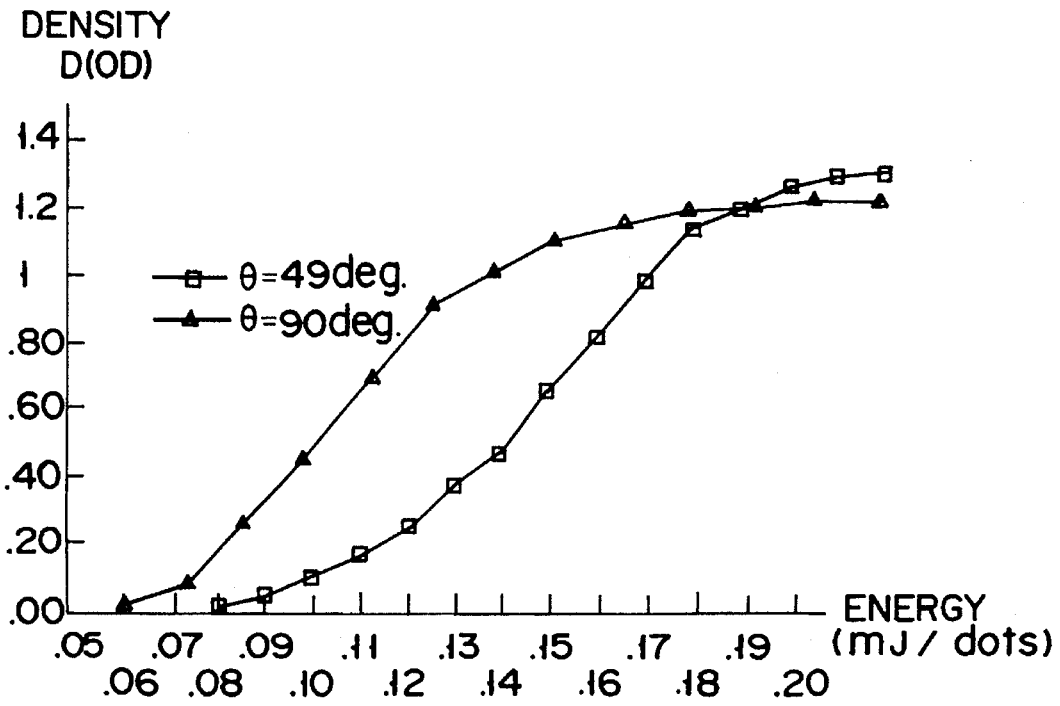
Figure 20:
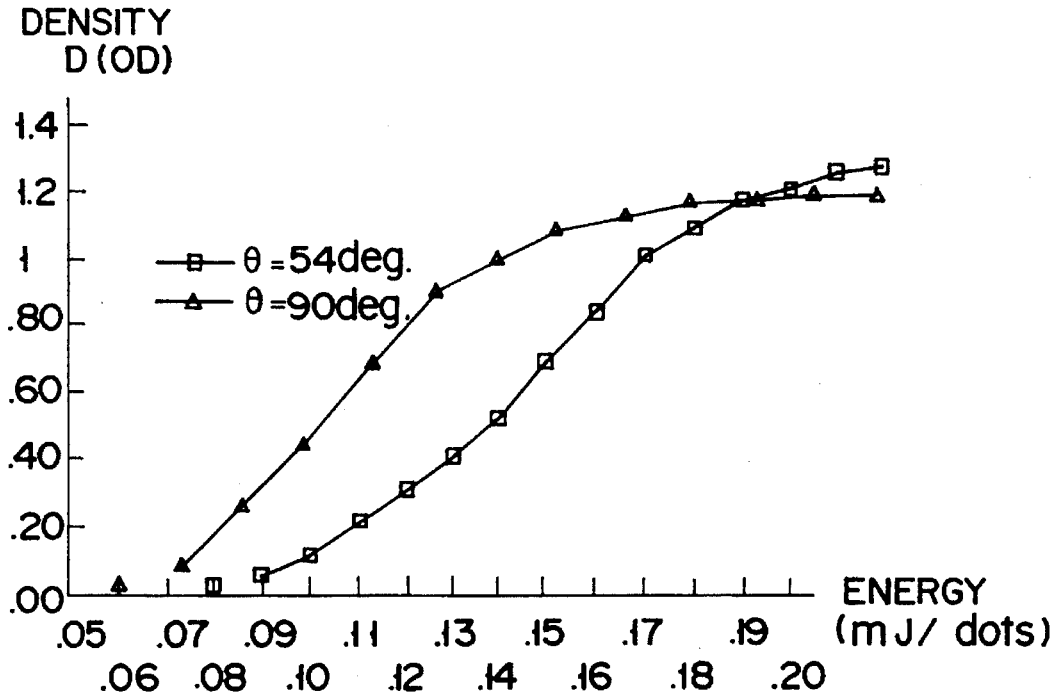
Figure 21:
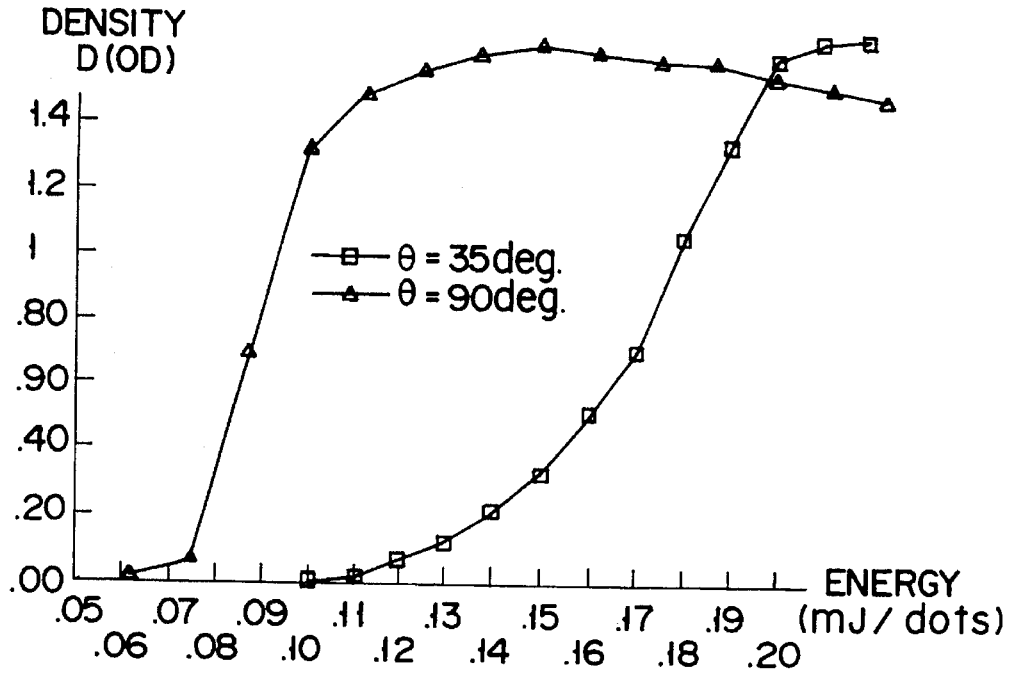
Figure 22:
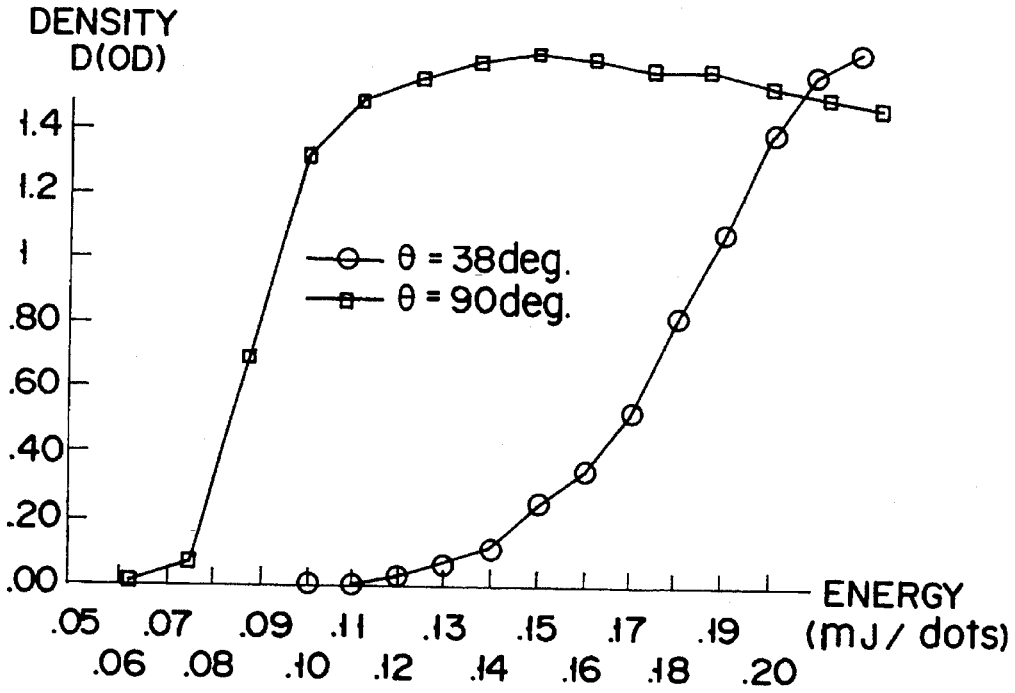
Figure 23:
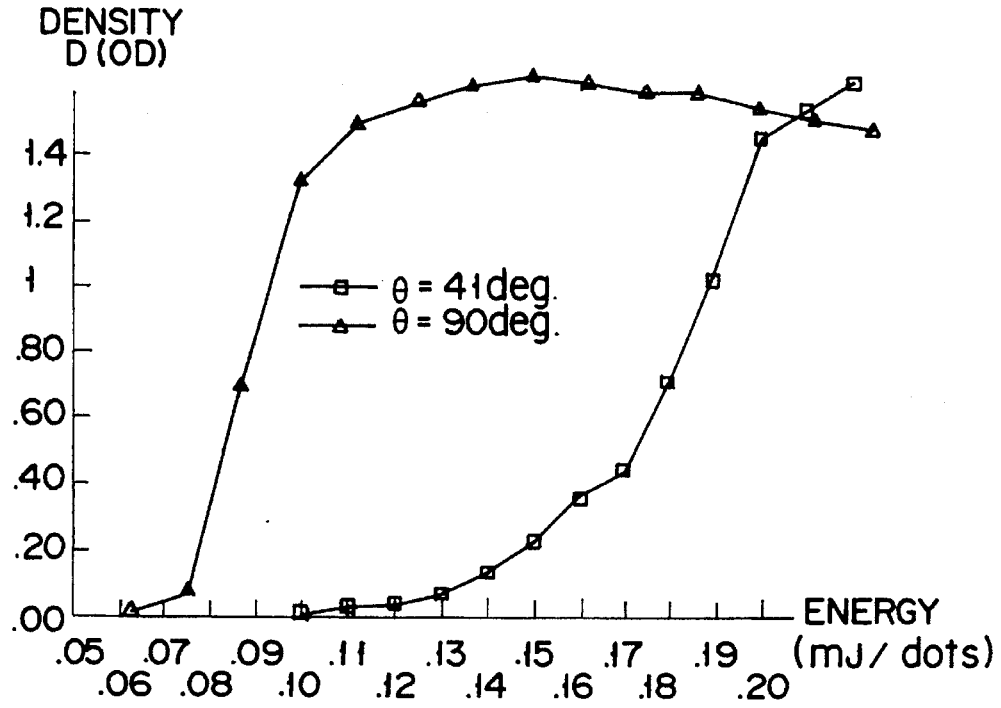
Figure 24:
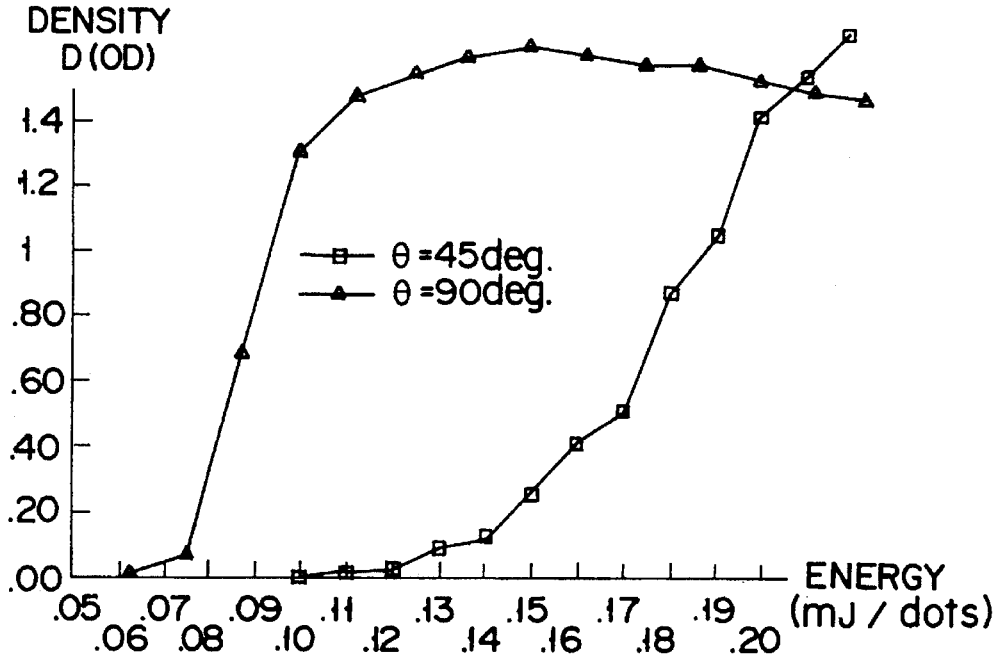
Figure 25:
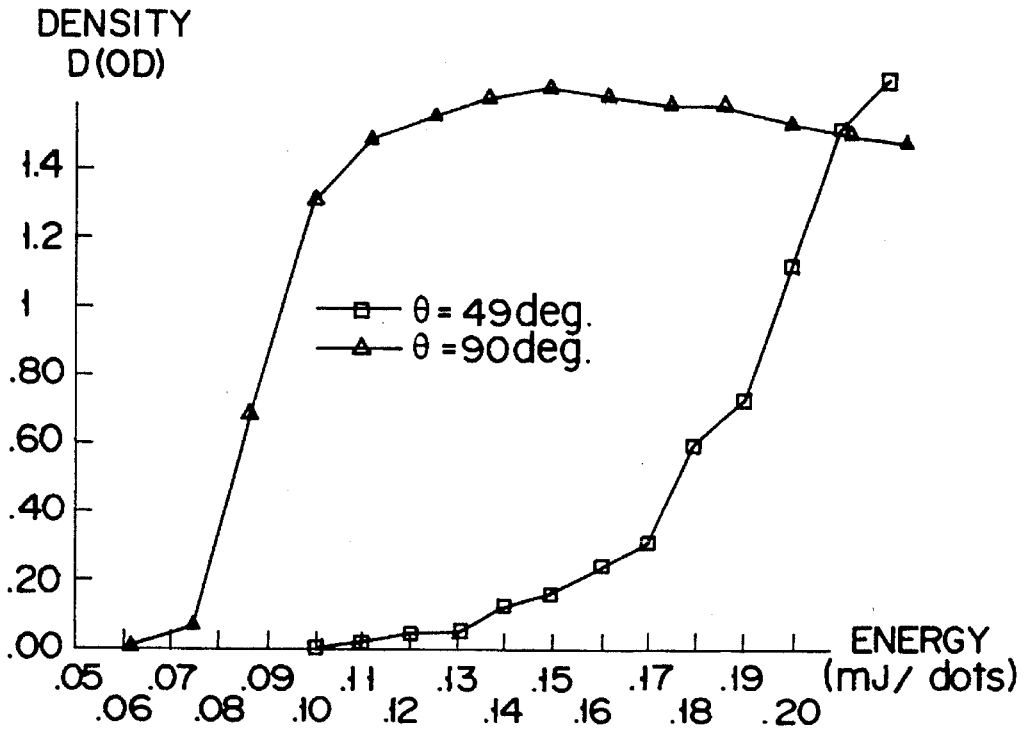
Figure 26:
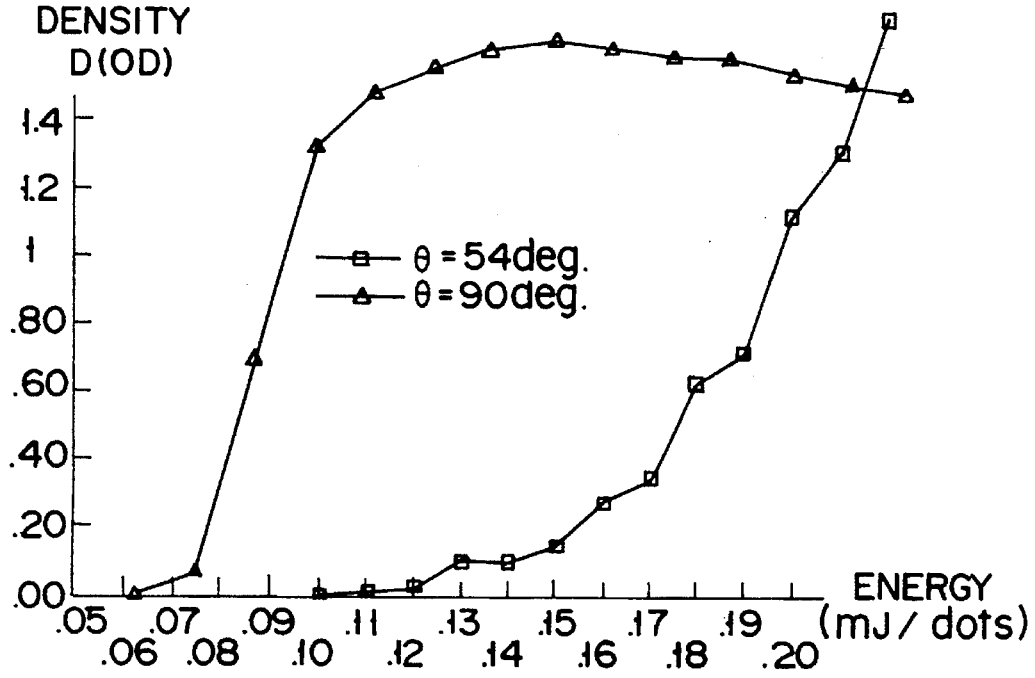

If the width and height of the heating resistor 14 are determined in this manner, the recording characteristic depends on the angle θ. If the angle θ is relatively wide, as shown in FIG. 12A, the degree of heat concentration is low, so that the recording characteristic curve is supposed to have a sharp leading edge, as shown in FIG. 12B. If the angle θ is medium, as shown in FIG. 13A, the heat concentration is conspicuous, so that the recording characteristic curve is supposed to have a gentle leading edge, as shown in FIG. 13B. If the angle θ is relatively narrow, as shown in FIG. 14A, heating resistor 14 is elongated, so that the degree of heat concentration is low, and therefore, the recording characteristic curve is supposed to have a sharp leading edge, as shown in FIG. 14B.

In half-tone printing, it is advisable to use a recording characteristic curve having a gentle leading edge. If the width and height of each heating resistor 14 are specified, therefore, the presence of the optimum angle θ can be expected.

Accordingly, in order to determine optimum angles for practical use, thermal heads were manufactured by way of trial using various angles θ of 35°, 38°, 41°, 45°, 49°, and 54° in combination with La=100 μm and h=70 μm, and the recording characteristics for the heat-sensitive recording system and thermal-transfer recording system were measured. Table 1 shows evaluation conditions for this measurement, and FIGS. 15 to 26 show the results of the measurement.

TABLE 1

| Item | Subitem | Contents |
|---|---|---|
| Heat-sensitive recording | Recording paper | TF50KS-E4 (commercially available) |
| Thermal-transfer recording | Recording paper | TRW-C2 (commercially available) |
| | Ink film | TRX-21 (3.5 μm) (commercially available) |
| Recording conditions | Recording speed | 5 ms/line |
| | Way of applying recording energy | Pulse-width-fixed voltage changing method |
| | Recording pulse width | 2 ms/pulse |
| Method of measurement | Measurement sample | Solid black density |
| | Measurement apparatusnt | Macbeth densitometer |

FIGS. 15 to 20 show recording characteristic curves obtained with use of the heat-sensitive system. The curves of FIGS. 15, 16, 17, 18, 19 and 20 represent the recording characteristics of thermal heads having heating resistors whose angles θ are 35°, 38°, 41°, 45°, 49°, and 54°, respectively.

FIGS. 21 to 26 show recording characteristic curves obtained with use of the thermal-transfer system. The curves of FIGS. 21, 22, 23, 24, 25 and 26 represent the recording characteristics of the thermal heads having the heating resistors whose angles θ are 35°, 38°, 41°, 45°, 49°, and 54°, respectively.

In FIGS. 15 to 26, recording characteristic curves for a thermal head having rectangular heating resistors (angle θ=90°) are illustrated for comparison.

Figure 27:
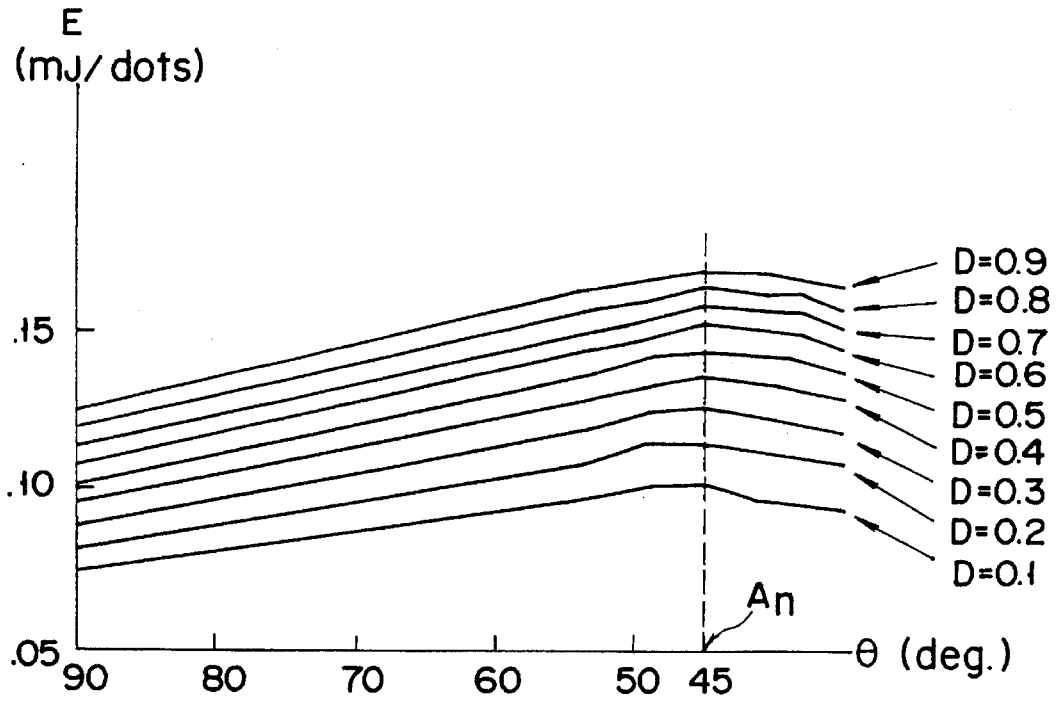
FIG. 27 shows equidensity curves representing various recording densities obtained with use of a heat-sensitive recording system.
Figure 28:
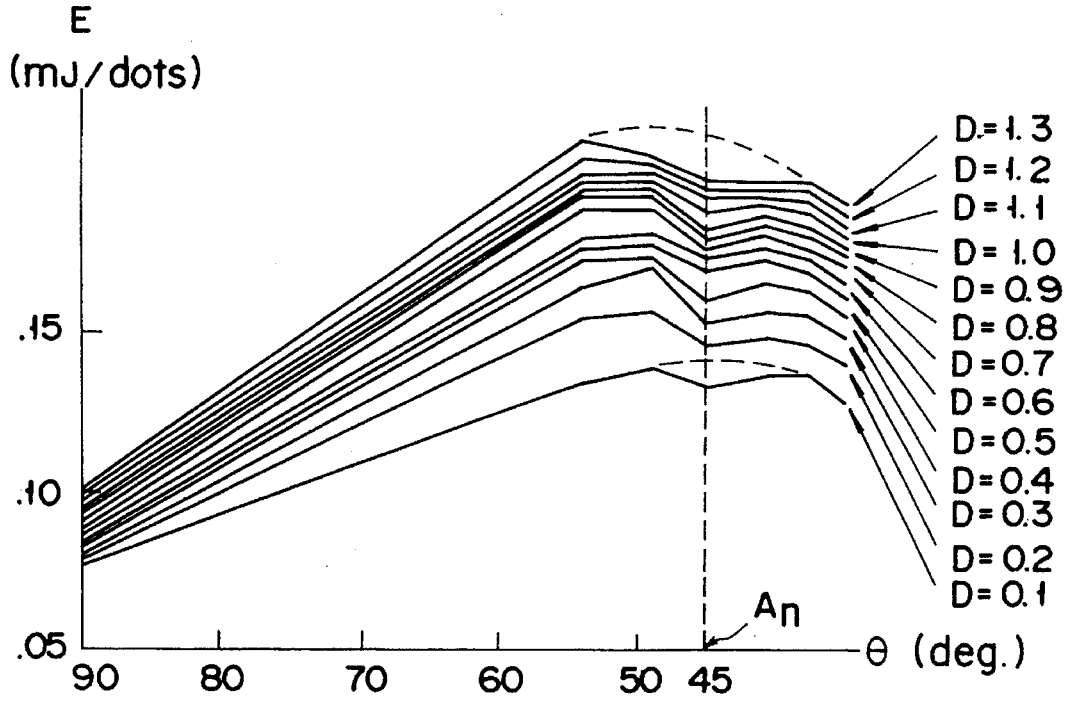
FIG. 28 shows equidensity curves representing various recording densities obtained with use of a thermal-transfer recording system.

FIGS. 27 and 28 show 0.1-interval equidensity curves related to recording densities obtained with use of the heat-sensitive recording system and thermal-transfer recording system, respectively, and representing relationships between the energy E and angle θ.

An optimum angle $A_n$ for the half-tone printing is obtained corresponding to the point at which the equidensity curves are at the widest intervals. In the heat-sensitive recording system, as seen from FIG. 27, the optimum angle $A_n$ is 45°.

As regards the thermal-transfer recording system, on the other hand, it may be believed that essential equidensity curves free of the influences of data-dispersive factors (e.g., applied pressure, positions of heating resistors within the nip width, etc.) should be the characteristic curves indicated by broken lines in FIG. 28. The optimum angle $A_n$ inferred from these characteristic curves of FIG. 28 is also 45°.

As seen from FIGS. 27 and 28, moreover, the lower the recording energy, the wider the intervals between the equidensity curves are. This indicates that more gradations can be assigned with lower densities, ensuring satisfactory half-tone printing.

As described above, the conditions for the optimum shape of each heating resistor 14 are $g \leqq 1$ and $\theta \leqq 45$.

In the thermal head of the present embodiment, the angle θ, height h, ratio g, and the lengths La and Lb of the sides 14*a* and 14*b* of each heating resistor 14 have the following relationships:

$$g = Lb/La, \quad (9)$$

$$h/Lb = \sin\theta \quad (10)$$

Eliminating the length Lb by substituting equation (9) into equation (10) and regarding the length La as 100 μm, as mentioned before, we obtain $$h/100\ g=\sin\theta. \quad (11)$$

Figure 29:
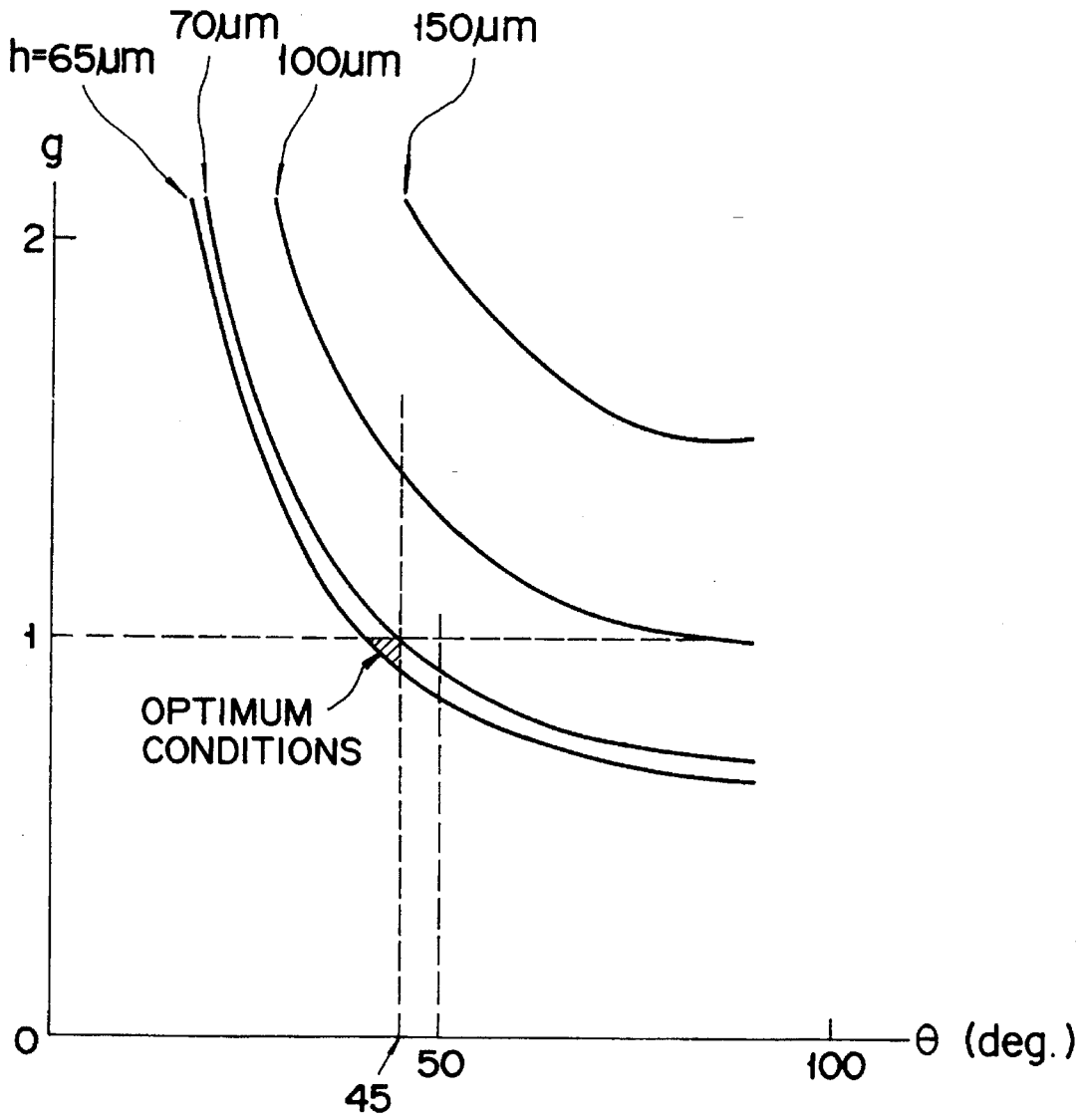
FIG. 29 is a diagram for illustrating the optimum conditions for the manufacture of the thermal head.

Equation (11) is illustrated in the graph of FIG. 29 in which the axes of abscissa and ordinate represent the angle θ and ratio g, respectively, and the height h is used as a parameter. In FIG. 29, the curve moves to the right as the height h increases.

The hatched region of FIG. 29 corresponds to a range in which the requirements ($g \leqq 1$ and $\theta \leqq 45$) and the requirement ($h \leqq 65$ μm) provided by the standards for standard-G3 facsimiles are all fulfilled.

Thus, the conditions for the optimum shape of the heating resistors 14 of a thermal head used in a standard-G3 facsimile are h=70 μm and θ=45° if the width La=100 μm.

Prevailing resolutions of the standard-G3 facsimiles include, for example, 8 dots/mm×7.7 lines/mm and 8 dots/mm×3.85 lines/mm. These resolutions in the auxiliary scanning direction are lower than 15.4 lines/mm. Although the thermal head according to the above embodiment is suited for the case where the resolution in the auxiliary scanning direction is 15.4 lines/mm, it cannot be applied to such low-resolution recording.

Figure 30:
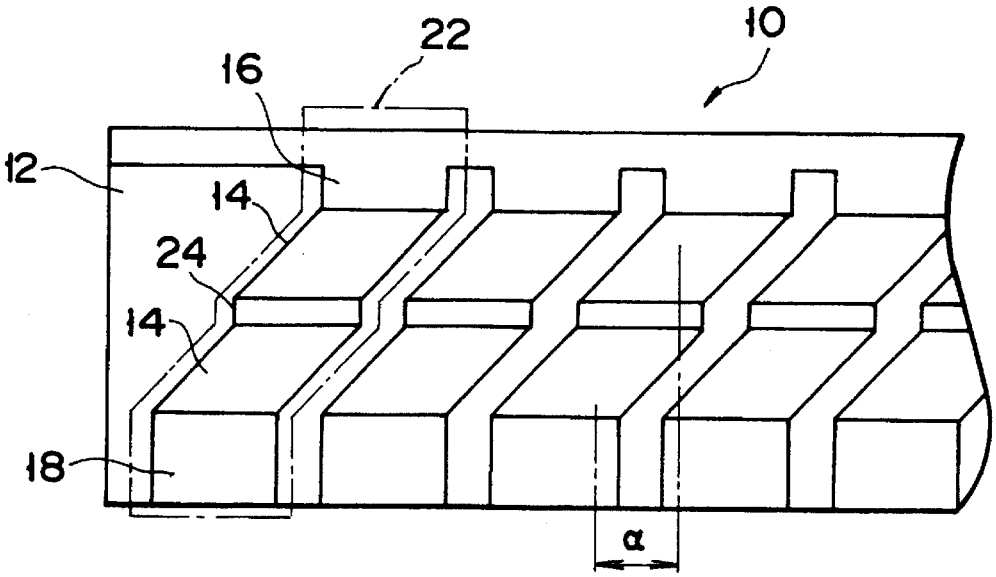
FIG. 30 is a schematic view showing the configuration of a thermal head according to another embodiment of the invention.

Referring now to FIG. 30, a thermal head according to another embodiment of the present invention suited for low-resolution recording will be described. In FIG. 30, like reference numerals refer to members equivalent to the ones used in the foregoing embodiment, and a detailed description of those members is omitted.

The thermal head 10 comprises a large number of heating elements 22 for recording one printing dot each. These elements 22 are arranged one-dimensionally at regular intervals on an insulated substrate 12. Each heating element 22 includes two heating resistors 14 which are connected electrically to each other by means of an intermediate electrode 24 formed of high-conductivity material. The intermediate electrode 24, which is in the form of a rectangle having the same width as each heating resistor 14, connects the adjacent sides of the resistors 14. The respective other sides of the resistors 14 are connected individually to lead electrodes 16 and 18. Thus, the two heating resistors 14 are connected electrically in series with each other.

In the thermal head constructed in this manner, the two heating resistors 14 included in each heating element 22 cooperate with each other to function as one heating section, thereby recording only one printing dot. Thus, if each heating resistor 14 has the same shape as in the foregoing embodiment, that is, if the width, height, and angle are 100 μm, 70 μm, and 45°, respectively, the height of the heating section is about 140 μm, which corresponds to 7.7 lines/mm.

At this time, although one of the heating resistors 14 is temporarily subjected to current concentration, the current is uniform in the intermediate electrode 24. Namely, the intermediate electrode 24 serves as an equipotential surface, and similar current concentration is caused in the other heating resistor 14. Thus, the heating characteristics are suited for gradation recording, and satisfactory gradation recording can be effected with the resolution of 8 dots/mm×7.7 lines/mm.

Figure 31:
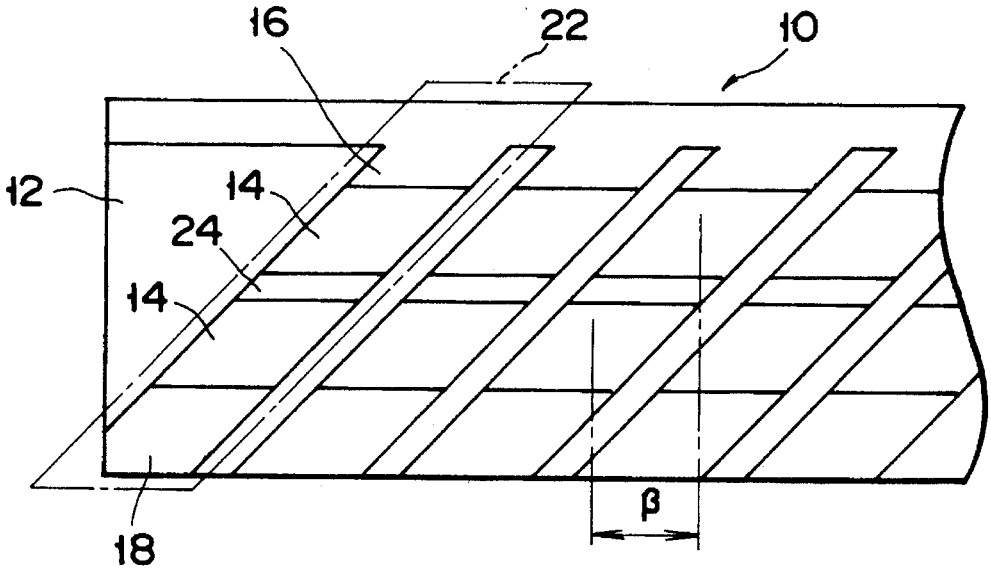
FIG. 31 is a schematic view showing the configuration of a thermal head according to still another embodiment of the invention.

Referring now to FIG. 31, still another embodiment of the present invention will be described. In a thermal head 10 according to this embodiment, an intermediate electrode 24 is in the shape of a parallelogram inclined at the same angle as heating resistors 14. Also, lead electrodes 16 and 18 are inclined at the same angle as the resistors 14. Thus, the heating resistors 14, intermediate electrode 24, and lead electrodes 16 and 18 are arranged in a straight line.

Accordingly, satisfactory gradation recording can be effected with the resolution of 8 dots/mm×7.7 lines/mm in the same manner as in the foregoing embodiments, and the following effect can be obtained. In the thermal head 10, which is manufactured by thin film formation technique, the intermediate electrode 24 and the lead electrodes 16 and 18 are formed by the photo-etching process (PEP). More specifically, the thermal head 10 is manufactured by selectively forming the intermediate electrode 24 and the lead electrodes 16 and 18 on a plurality of parallelogrammatic resistors including two heating resistors 14 in each heating element 22. Thus, when the heating resistors 14, intermediate electrode 24, and lead electrodes 16 and 18 are formed in a straight line, as in the case of the thermal head 10 of this embodiment, photo-etching masks, used to form the electrodes 16, 18 and 24, must be strictly aligned only in one direction of the array of the heating elements 22, and this operation is easy.

The respective centers of the two heating resistors 14 included in each heating element 22 are deviated in the main scanning direction (arrangement direction of the heating members 22) by a in the thermal head of FIG. 30 and by β in the case of FIG. 31. Thus, two heating regions for forming one printing dot are deviated individually by a and D in the main scanning direction, so that the quality of some of recorded images may possibly be lowered.

Figure 32:
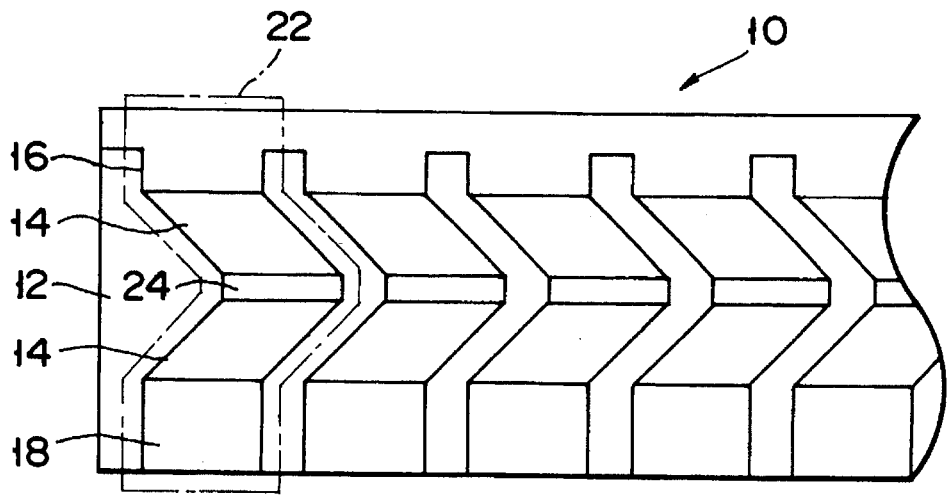
FIG. 32 is a schematic view showing the configuration of a thermal head according to a further embodiment of the invention.

Referring now to FIG. 32, a further embodiment of the present invention will be described. In this embodiment, which is arranged in consideration of these circumstances, a thermal head 10 is constructed in the same manner as the thermal head shown in FIG. 30, provided that two parallelogrammatic heating resistors 14 included in each heating element 22 are inclined in opposite directions. In this arrangement, the two heating resistors 14, used to record one printing dot, are situated on one and the same auxiliary scanning line without being deviated in the main scanning direction. Accordingly, satisfactory gradation recording can be effected with the resolution of 8 dots/mm×7.7 lines/mm, and improved recording can be ensured without entailing deterioration in printed image quality.

Figure 33:
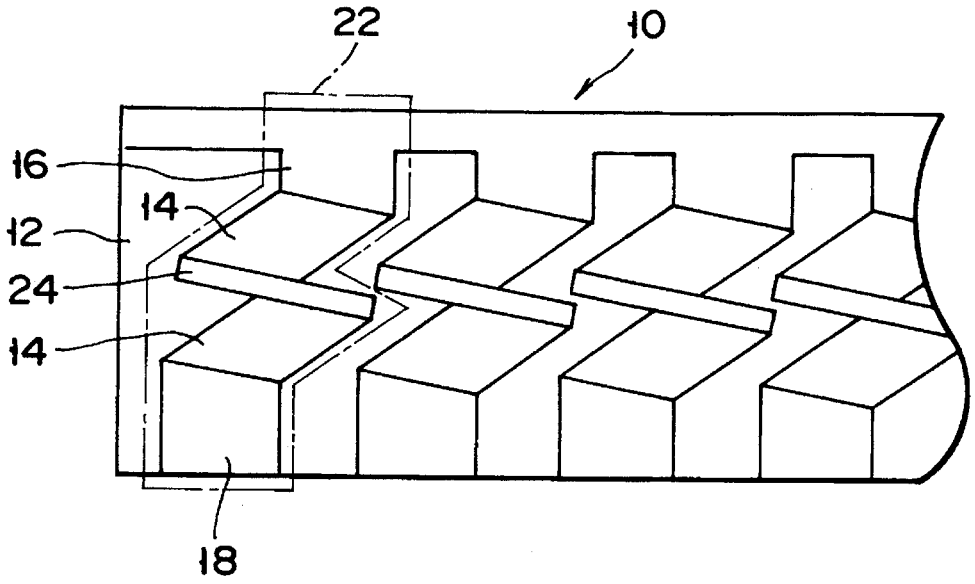
FIG. 33 is a schematic view showing the configuration of a thermal head according to a still further embodiment of the invention.

Referring now to FIG. 33, moreover, a still further embodiment of the present invention will be described. In a thermal head 10 of this embodiment, two heating resistors 14 included in each heating element 22 are arranged parallel to each other so that their respective centers are situated on one and the same auxiliary scanning line. As in the case of the thermal head shown in FIG. 32, therefore, the heating resistors 14 in the heating element 22 are situated on the same auxiliary scanning line, so that satisfactory gradation recording can be effected with the resolution of 8 dots/mm×7.7 lines/mm, and improved recording can be ensured without entailing deterioration in printed image quality.

It is to be understood that the present invention is not limited to the embodiments described above, and that various changes and modifications may be effected therein by one skilled in the art without departing from the scope or spirit of the invention. Although the thermal heads according to the embodiments described above are applied to standard-G3 facsimiles, for example, they may be naturally applied also to any other suitable apparatuses. Thus, the heating resistors are not restricted to the conditions including the width La=100 μm, height h=70 μm, and angle η=45°. In the above embodiments, moreover, each heating element includes two heating resistors to provide the resolution of 8 dots/mm×7.7 lines/mm. Alternatively, however, four heating resistors may be used in each heating element to obtain a resolution of 8 dots/mm×3.85 lines/mm. Further, any desired resolution may be obtained by suitably changing the number of heating resistors in each heating element. In addition, though printing-dots are changed in size by applying various voltages to the resistor in the above embodiments, they may be changed by varying time for supplying electric current to the resistor.

What is claimed is:

1. A line-type thermal head for half-tone printing which expresses various densities by utilizing printing dots of various sizes, the thermal head having a main scanning axis and comprising:

a substrate;

a plurality of heating elements arranged on the substrate along the main scanning axis, each of the heating elements including at least one non-rectangular parallelogrammatic resistor for generating heat; and means for supplying electric energy, an amount of which corresponds to a size of a printing dot to be recorded, to each of the heating elements to make the resistor generate heat, wherein the resistor has a region which generates sufficient heat for recording the printing dot, and a size of the region is changed in response to the amount of electric energy applied to the resistor so that printing dots having various sizes are produced by each of the resistors, the supply means including lead electrodes connected electrically to one pair of opposite sides of the resistor, each of the lead electrodes having a width not less than a length of one side of the one pair of opposite sides of the resistor;

wherein a ratio of the length of one side of the one pair of opposite sides of the resistor to that of one side of another pair of opposite sides of the resistor is not greater than 1.5, and an acute angle formed by two sides of the one and another pair of opposite sides of the resistor is no more than 45°.

2. The thermal head according to claim 1, wherein each of the heating elements includes a plurality of resistors for generating heat and at least one intermediate electrode electrically connecting facing sides of any two adjacent resistors of the plurality of resistors in the heating element which are adjacent.

3. The thermal head according to claim 2, wherein in each of the heating elements, a length of a portion of the intermediate electrode which is connected to the facing side of each of the two adjacent resistors is not less than a length of each facing side to which it is connected, and the two adjacent resistors are electrically connected in series with each other by means of the intermediate electrode.

4. The thermal head according to claim 3, wherein in each of the heating elements, the intermediate electrode and the resistors together form a structure having a non-rectangular parallelogrammatic shape.

5. The thermal head according to claim 3, wherein in each of the heating elements, the two adjacent resistors connected by means of the intermediate electrode are located linearly symmetrical with respect to each other.

6. The thermal head according to claim 3, wherein in each of the heating elements, the plurality of resistors connected to each other by means of the intermediate electrode are aligned along an axis perpendicular to the main scanning axis.

7. A line-type thermal head for half-tone printing which expresses various densities by utilizing printing dots of various sizes, the thermal head having a main scanning axis and comprising:

a substrate;

a plurality of heating elements each of which includes two strip-like lead electrodes and a non-rectangular parallelogrammatic resistor located between the lead electrodes, the parallelogrammatic resistor having first and second pairs of opposite sides, each of the lead electrodes having an end and generally parallel sides, the ends of the lead electrodes being coincident with the first pair of opposite sides of the resistor, the parallel sides of the lead electrodes being aligned with the second pair of opposite sides of the resistor, and the heating elements being arranged on the substrate along the main scanning axis so that the first pairs of opposite sides of all resistors are aligned;

wherein a ratio of a length of one side of the second pair of opposite sides of the resistor to that of one side of the first pair of opposite sides of the resistor is not greater than 1.5.

8. The thermal head according to claim 7, wherein an acute angle of the parallelogrammatic resistor, which is formed by two adjacent sides of the resistor, is not greater than 45°.

9. A line-type thermal head for half-tone printing which expresses various densities by utilizing printing dots of various sizes, the thermal head having a main scanning axis and comprising:

a substrate;

a plurality of heating elements each of which includes two strip-like lead electrodes, first and second non-rectangular parallelogrammatic resistors located between the lead electrodes, and a parallelogrammatic intermediate electrode located between the first and second resistors, each of the parallelogrammatic resistors and intermediate electrode having first and second pairs of opposite sides, a side of the first pair of opposite sides of the intermediate electrode being coincident with a side of the first pair of opposite sides of the first resistor, the other side of the first pair of opposite sides of the intermediate electrode being coincident with a side of the first pair of opposite sides of the second resistor, and the second pair of opposite sides of the intermediate electrode being aligned with the second pairs of opposite sides of the first and second resistors, each of the lead electrodes having an end and generally parallel sides, the ends of lead electrodes being coincident with the other sides of the first pairs of opposite sides of the first and second resistors, the parallel sides of the lead electrodes being aligned with the second pairs of opposite sides of the first and second resistors, and the heating elements being arranged on the substrate along the main scanning axis so that the first pairs of opposite sides of all first resistors are aligned and the first pairs of opposite sides of all second resistors are aligned;

wherein a ratio of a length of one side of the second pair of opposite sides of the resistors to that of one side of the first pair of opposite sides of the resistors is not greater than 1.5.

10. The thermal head according to claim 9, wherein an acute angle of each parallelogrammatic resistor, which is formed by two adjacent sides of the resistor, is not greater than 45°.

* * * * *